United States Patent [19]

Habermann

[11] Patent Number: 4,856,749

[45] Date of Patent: Aug. 15, 1989

[54] EXPANDABLE EASEL

[76] Inventor: Patrick R. Habermann, 750 Conn Valley Rd., St. Helena, Calif. 94574

[21] Appl. No.: 290,884

[22] Filed: Dec. 22, 1988

Related U.S. Application Data

[63] Continuation of Ser. No. 50,329, May 18, 1987, abandoned.

[51] Int. Cl.[4] ..... A47B 27/04

[52] U.S. Cl. ..... 248/448; 248/451; 248/460

[58] Field of Search ..... 248/558, 441.1, 448–453, 248/460, 122, 149, 179; 40/1, 155, 610

[56] References Cited

U.S. PATENT DOCUMENTS

| | | | |
|---|---|---|---|
| 364,991 | 6/1887 | Cross | 248/449 |
| 391,608 | 10/1888 | Hartwell | 248/449 |
| 751,408 | 2/1904 | Pettit | 248/452 |
| 774,264 | 11/1904 | Moreland | 248/449 |
| 926,840 | 2/1909 | Bagaason | 248/451 |
| 1,576,154 | 3/1926 | Steinman | 248/448 |
| 2,140,674 | 12/1938 | Hassett | 248/448 |
| 2,739,776 | 3/1956 | Terando | 248/172 |
| 2,799,488 | 3/1974 | Sena | 248/452 |
| 2,992,464 | 2/1961 | Muhlemann | 248/452 |
| 3,095,666 | 7/1963 | Killen | 248/452 |
| 3,114,215 | 12/1963 | Turkin | 248/449 |
| 3,226,077 | 12/1965 | Killen | 248/460 |
| 3,231,230 | 1/1966 | Mueller | 248/449 |
| 3,330,524 | 7/1967 | Foley | 248/441.1 |
| 3,733,689 | 5/1973 | Armitage | 248/448 |
| 4,042,203 | 8/1977 | Warkentin | 248/449 |
| 4,165,856 | 8/1979 | Wiseheart | 248/449 |
| 4,558,522 | 12/1985 | Lance | 248/449 |

FOREIGN PATENT DOCUMENTS

| | | | |
|---|---|---|---|
| 212437 | 2/1908 | Fed. Rep. of Germany | 248/448 |
| 2921898 | 12/1980 | Fed. Rep. of Germany | 248/449 |
| 255059 | 6/1948 | Switzerland | 298/460 |
| 409829 | 5/1934 | United Kingdom | 248/452 |

*Primary Examiner*—Alvin C. Chin-Shue
*Assistant Examiner*—Robert A. Olson
*Attorney, Agent, or Firm*—Flehr, Hohbach, Test, Albritton & Herbert

[57] ABSTRACT

Expandable easel which can hold canvases and other work pieces having a wide variety of sizes and shapes in a number of different positions. The easel includes a frame having a pair of upstanding posts and at least one cross member extending between the posts, with a plurality of work piece holders mounted on the frame. The posts and the cross member each have a plurality of telescopically extensible sections, and the work piece holders are mounted on arms which can be mounted in different rotative positions on the frame to accommodate work piece of different sizes. The work piece holders can also be rotated on the arms which carry them to accommodate different work pieces. The frame can also be tilted back to support a work piece in a horizontal direction.

20 Claims, 5 Drawing Sheets

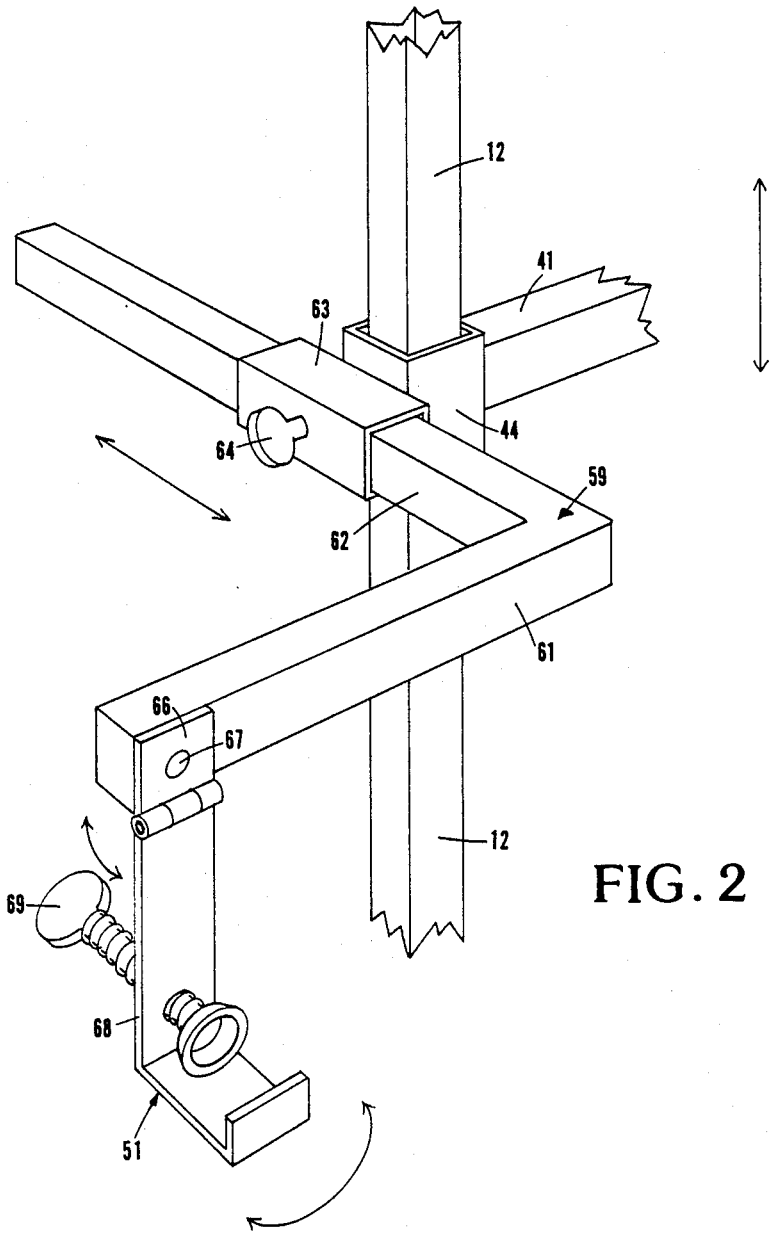
FIG. 2
FIG. 3
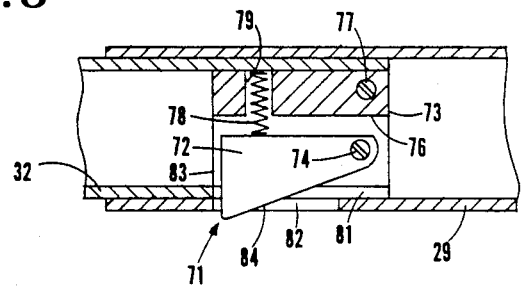

EXPANDABLE EASEL

This is a continuation of application Ser. No. 050,329 filed May 18, 1987, now abandoned.

This invention pertains generally to easels for holding canvases and other work pieces, and more particularly to an easel which can be configured to hold work pieces of different sizes and shapes.

The canvases and other work pieces used by artists come in an almost limited variety of sizes and shapes. The easels which have heretofore been provided for holding such work pieces have been limited in that most easels are designed to hold a specific size and shape of work pieces or a relatively limited range of sizes and shapes.

With portable easels and adjustable easels, there is also a problem of stability since the construction which permits the easel to be knocked down or adjusted can make the easel unstable when it is set up or extended to hold larger work pieces.

It is in general an object of the invention to provide a new and improved easel for holding canvases and other work pieces.

Another object of the invention is to provide an easel of the above character which is relatively portable and highly stable.

These and other objects are achieved in accordance with the invention by providing an easel having a frame comprising a pair of upstanding posts and at least one cross member extending between the posts, with a plurality of work piece holders mounted on the frame. The posts and the cross member each have a plurality of telescopically extensible sections which permit the spacing between the work piece holders to be adjusted to hold work pieces of different sizes and shapes. The work piece holders are mounted on arms which can be rotated to further vary the spacing between the holders, and the frame can be tilted back to support a work piece in a horizontal position.

FIG. 1 an isometric view of one embodiment of an expand a easel according to the invention.

FIG. 2 is an enlarged fragmentary isometric view of one of the work piece holders in the embodiment of FIG. 1.

FIG. 3 is an enlarged cross-sectional view taken along line 3—3 in FIG. 1.

Figure 1:
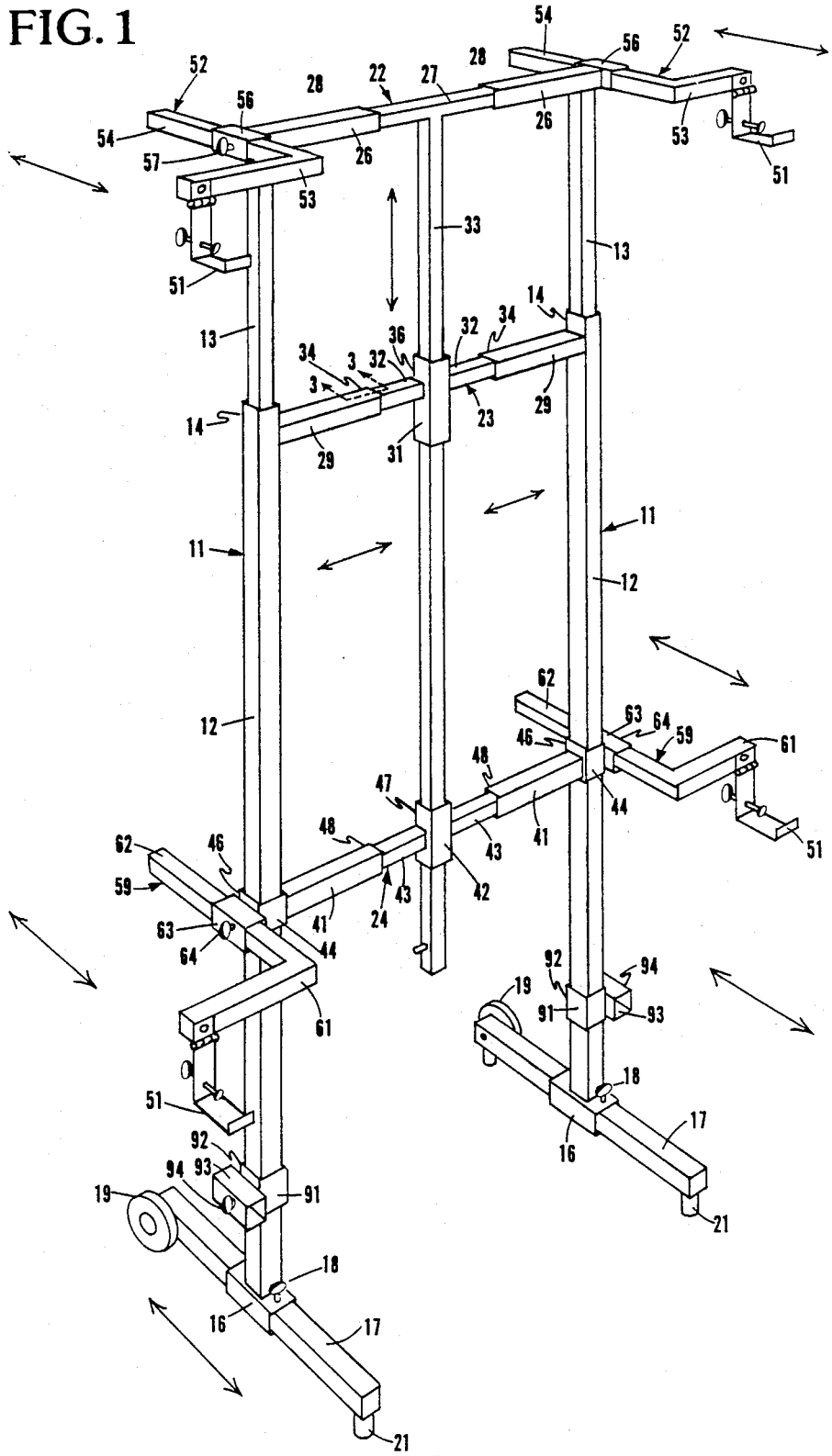

The easel includes a pair of upstanding posts 11, each of which has a lower section 12 and an upper section 13. The upper sections are telescopically mounted in the lower sections and can be extended and retracted to change the height of the posts. Thumbscrews 14 are threadedly mounted in the lower post sections for engagement with the upper post sections to hold them in a desired position.

The lower ends of post sections 12 have brackets 16 in which horizontally extending legs are slidably mounted to form a base for supporting the posts in an upright position. Thumbscrews 18 threadedly mounted in brackets 16 provide means for securing the posts in a desired position on the legs. Ground engaging wheels 19 are provided at the rear ends of the legs, and pads or feet 21 are provided at the front ends of the legs. This particular arrangement of wheels and pads is exemplary only, and it will be understood that a variety of other wheels and/or pads can be employed.

Cross members 22–24 of adjustable length extend between the posts to form a generally rectangular frame which can be adjusted through a relatively wide range of sizes in both height and width.

Upper cross member 22 comprises a pair of outer tubular sections 26 which are affixed to the upper ends of post sections 13 and a central section 27 which is telescopically received within the outer tubular sections. Some screws 28 are threadedly mounted in outer sections 26 for engagement with central section 27 to hold the sections in a desired position.

Central cross member 23 comprises a pair of outer tubular sections 29 and a central section 31 with arms 32 which are telescopically received in the outer sections. Outer sections 29 are affixed to the upper portions of lower post sections 12, and central section 31 is slidably mounted on a central post or arm 33 which is rigidly affixed to the central section 27 of upper cross member 22. Arms 32 are held in a desired position in tubular members 29 by some screws 34, and central post 33 is held in a desired position relative to cross member 23 by a thumbscrew 36.

Lower cross member 24 comprises a pair of outer tubular sections 41 and a central section 42 with arms 43 which are telescopically received in the outer sections. The outer ends of tubular sections 41 are affixed to sleeves 44 which are slidably mounted on the lower sections 12 of posts 11, with thumbscrews 46 for securing the lower cross member in a desired position on the posts. Central section 42 is slidably mounted on the lower portion of central post 33, with a thumbscrew 47 for securing the cross member and the post together. Thumbscrews 48 are threadedly mounted in outer tubular sections 41 for engagement with central arms 43 to hold these members in a desired position.

Work piece holders 51 are mounted on the frame for engagement with a canvas and other work pieces to be held by the easel. In the embodiment illustrated, four work piece holders are provided, and they are arranged in upper and lower pairs.

The upper work piece holders are mounted on L-shaped arms 52, each of which has a short section 53 and a long section 54. The work piece holders are mounted toward the outer ends of the short sections, and the long sections are slidably mounted in sleeves 56 which are affixed to the outer ends of cross member 22. The arms are secured in a desired position in the sleeves by thumbscrews 57.

The lower work piece holders are mounted on L-shaped arms 59 which are similar to arms 52. Each of these arms has a short section 61 and a long section 62, with the work piece holder being mounted toward the end of the short section and the long section being slidably received in a sleeve 63 affixed to the outer end of cross member 24. Thumbscrews 64 secure the arms in a desired position in the sleeves.

As best illustrated in FIG. 2, each of the work piece holders 51 has a base 66 which is pivotally mounted on the short section of the L-shaped arm 52, 59 by a pin 67 for rotation about an axis parallel to the long section of the arm. A J-shaped arm 68 is hingedly connected base 66, with a clamping screw 69 threadedly mounted in the longer section of the J-shaped arm in alignment with the shorter section. Being rotatable about two perpendicular axes, the clamp can be moved to any desired orientation for holding a work piece.

Stops 71 carried by lower cross member 24 limit the outward movement of posts 11 and prevent the cross members from being accidentally pulled apart. As illustrated in FIG. 3, each of the stops comprises a generally triangular member 72 pivotally mounted in a rectangular block 73 at the outer end of arm 43. The stop member is mounted on a pin 74 in a slotted opening 76 in the lower portion of the block, and the block is retained in the tubular arm by a pin 77. The free end of stop member 72 is urged in a downward direction by a coil spring 78 mounted in a circular board 79 in block 73. The stop member passes through a slotted opening 81 in the lower wall of arm 43 and is received in a short slotted opening 82 near the inner end of outer tubular member 41 when the lower cross member is in its fully extended position. The surface 83 at the inner end of stop member 72 is generally perpendicular to the axis of arm 43 and abuts against the outer end of slot 82 to limit the outward movement of tubular member 41 relative to arm 43. The inwardly facing surface 84 of stop member 72 is inclined for engagement with the inner end of slot 82 to depress the stop member and thereby disengage the stop member from the slot as tubular member 41 is moved in an inward direction. Stop member 72 can be depressed manually to disengage it from slot 82 when it is desired to remove tubular member 41 from arm 43.

Figure 4:
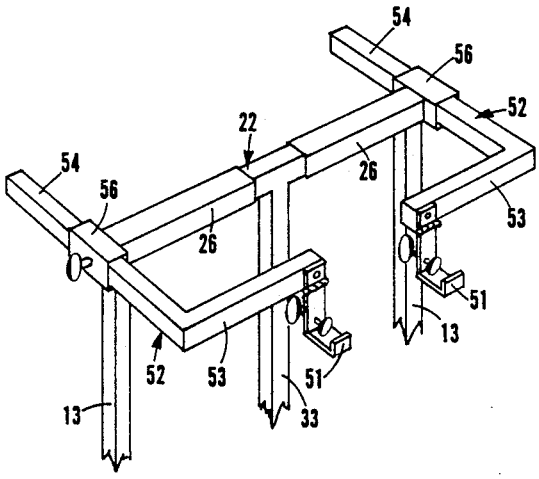
FIGS. 4–6 are fragmentary isometric views illustrating operation of the embodiment of FIG. 1.
Figure 5:
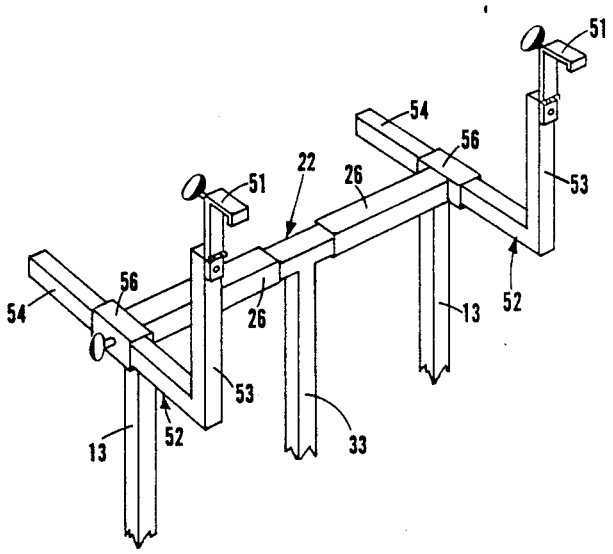
Figure 6:
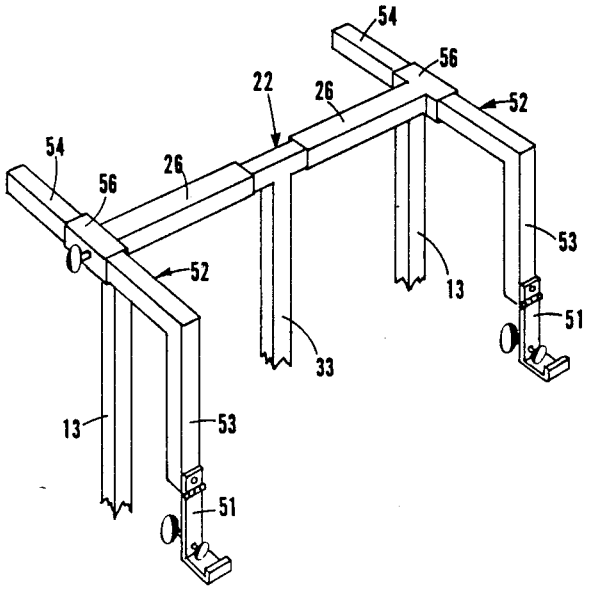

In the embodiment illustrated, L-shaped arms 52, 59 have a generally square cross-section, and they can be inserted in sleeves 56, 63 in different rotative positions to vary the spacing between the work piece holders. In FIG. 1, for example, the arms are positioned with the short sections 53, 61 extending in an outward direction. In FIG. 4, the arms are positioned with the short sections extending in an inward direction, in FIG. 5 the short sections extend in an upward direction, and in FIG. 6, the short sections extend in a downward direction. These figures also illustrate some of the positions to which the work piece holders 51 can be rotated.

The easel is extremely flexible from the standpoint from holding work pieces of different sizes and shapes. For larger work pieces, posts 11 and cross members 22–24 can be extended, and cross member 24 can be moved down on lower post sections 12. The holding capacity can be further increased by rotating arms 52, 59 to separate the work piece holder. For smaller work pieces, the posts and cross members can be retracted, and lower cross member 24 can be moved up on the lower sections of posts 11. For smaller work pieces, arms 52, 59 can also be turned to bring the work piece holders closer together. In one presently preferred embodiment, posts 11 can be adjusted, about 5 feet in height to about 10 feet in height, and cross members 22–24 can be adjusted, from about 20 inches to about 30 inches in length. In this embodiment, the short sections of L-shaped arms 52, 29 are approximately 8 inches long, the long sections of arms 52 are approximately 26 inches long, and the long sections of arms 59 are approximately 18 inches long. With these dimensions, the easel can hold pieces ranging in height from just a few inches to more than 10 feet. With the work piece holders positioned to engage the upper and lower edges of the work piece, the width of the work piece is limited primarily by the space available around the easel. When the work piece is held by its side edges, work pieces ranging in width from just a few inches to approximately 4 feet can be held.

The inclination of the work piece can be adjusted by extending and retracting the arms 52, 59 which carry the work piece holders.

Figure 7:
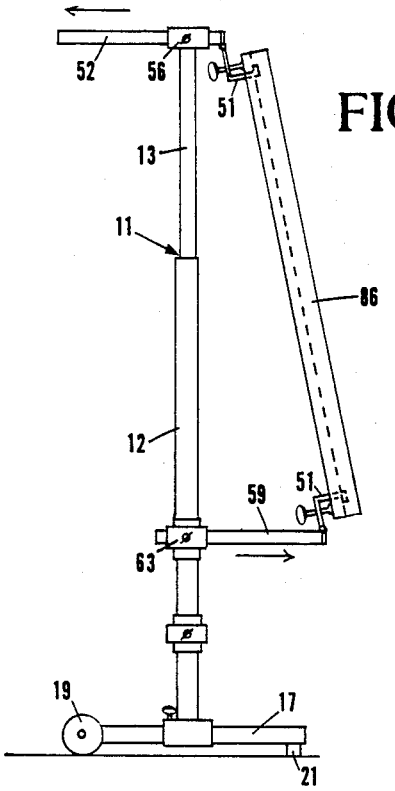
FIGS. 7–8 are side elevational views of the embodiment FIG. 1, illustrating the easel in different operative positions.

FIG. 7 illustrates upper arms 52 retracted and lower arms 59 extended, with a relatively large work piece 86 inclined in a upward direction.

Figure 8:
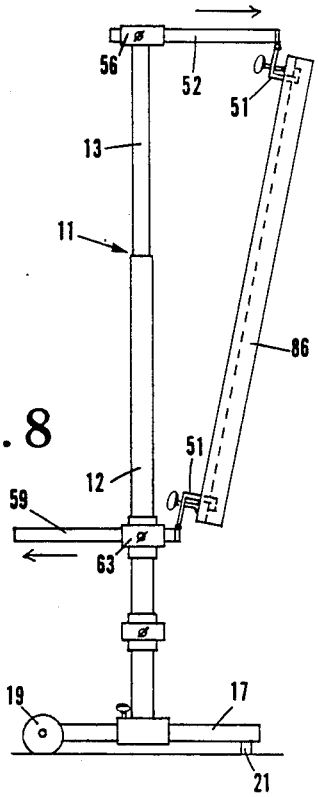

FIG. 8 illustrates upper arms 52 extended and lower arms 59 retracted, with the work piece 86 inclined in a downward direction. In these figures, the work piece comprises a canvas mounted on a peripheral frame, and the work piece holders 51 are positioned to engage the upper and lower frame members from within.

Figure 9:
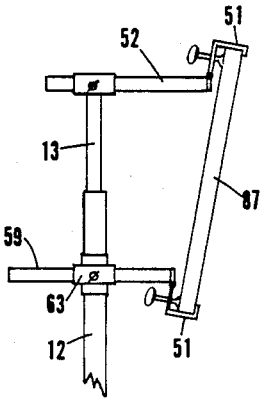
FIG. 9 is a fragmentary side elevational view of the embodiment of FIG. 1, illustrating the easel from another operating position with a relatively small work piece.

FIG. 9 illustrates the easel with the posts retracted and arms 52, 59 positioned as in FIG. 8 to hold a relatively small work piece 87 with a downward inclination. In this figure, the work piece holders 51 are turned to engage the upper and lower edges of the work piece from the outside.

Figure 10:
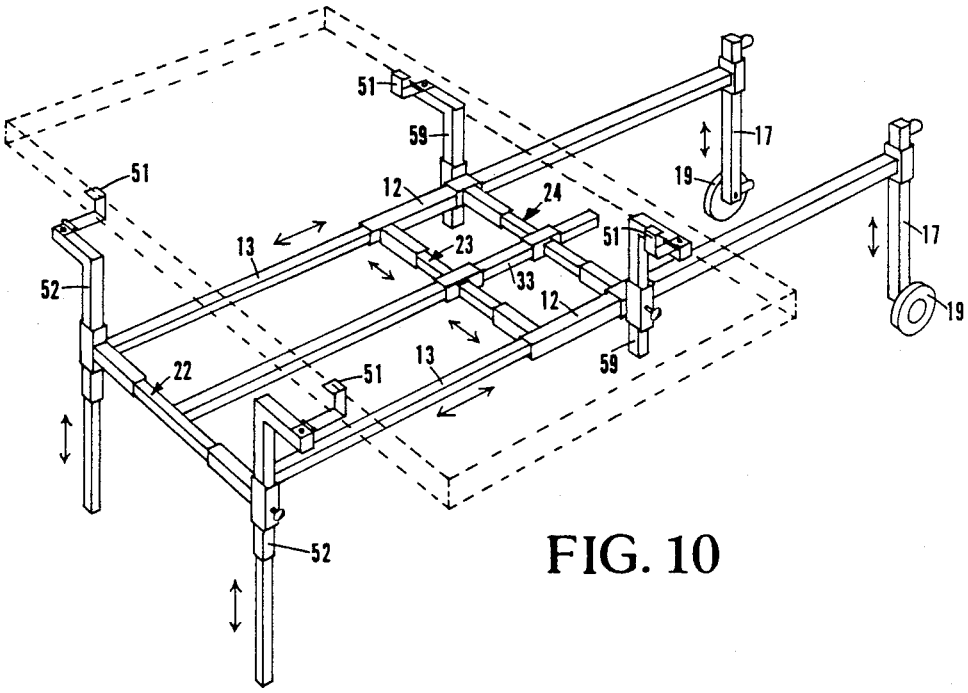
FIG. 10 is an isometric view of the embodiment of FIG. 1, illustrating the easel tilted back for holding a work piece in a horizontal position.

As illustrated in FIG. 10, the easel can be tilted back about wheels 19 to hold a work piece in a horizontal position, with the upper portion of the frame resting on arms 52. In this position, the inclination of the frame can be adjusted by adjusting the positions of arms 52 and legs 17, and the inclination of the work piece can be further adjusted by adjusting the position of arms 59 in sleeves 63.

Figure 11:
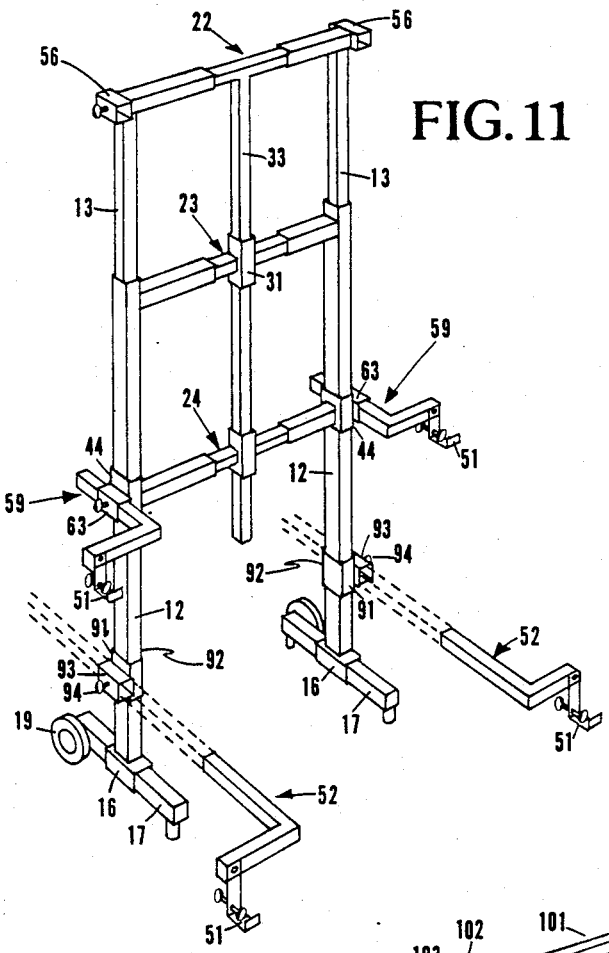
FIG. 11 is a partially exploded isometric view of another embodiment of an expandable easel according to the invention.
Figure 12:
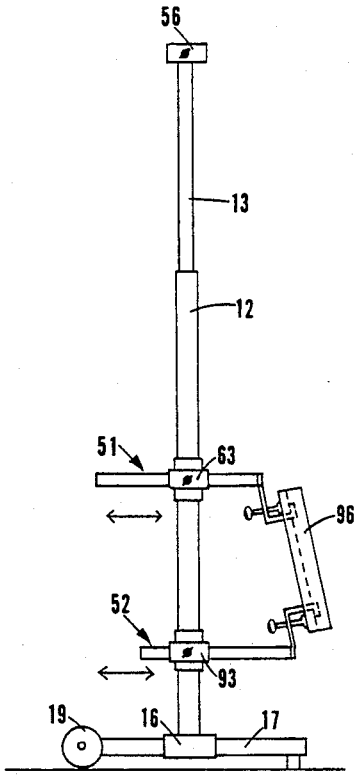
FIG. 12 is a side elevational view of the embodiment of FIG. 11.

The embodiment illustrated in FIGS. 11, 12 is similar to the embodiment of FIG. 1, and like reference numerals designate corresponding elements in the two embodiments. In the embodiment of FIGS. 11, 12, however, and additional pair of work piece holder brackets 91 are mounted on lower upright sections 12 below cross-member 24. These brackets are slideably mounted on the uprights, and they can be secured in a desired position by thumb screws 92. These brackets have sleeves 93 similar to sleeves 56, 63 and arms 52 can be removed from sleeves 56 and mounted in sleeves 93 for holding work pieces in a lower position on the uprights. Thumb screws 94 are provided for securing arms 52 in a desired position in sleeves 93. Alternatively, arms 59 can be removed from sleeves 63 and mounted in sleeves 93 to hold taller work pieces than can be held by holders mounted in sleeves 56 and 63. FIG. 12 illustrates a work piece 96 held in the lower position. This position is particularly convenient for an artist sitting in a chair.

Figure 13:
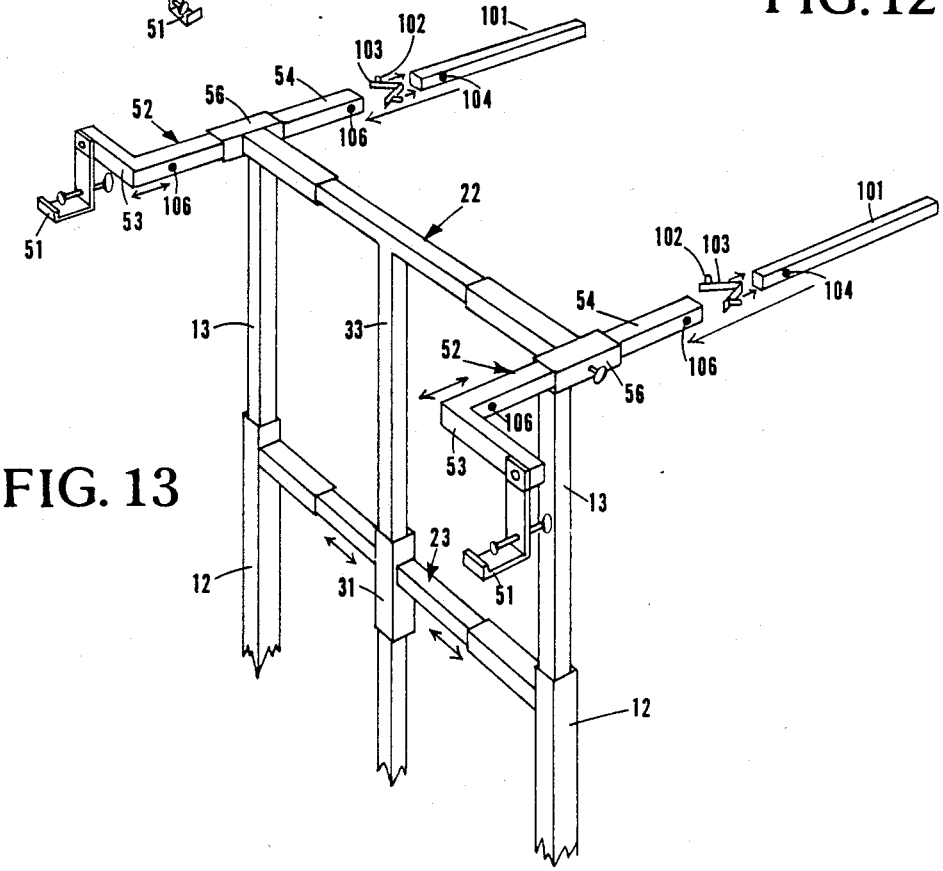
FIG. 13 is a fragmentary perspective view, partly exploded, of another embodiment of an expandable easel according to the invention.

The embodiment of FIG. 13 is also similar to the embodiment of FIG. 1, except that the upper work piece holder arms are formed in telescopically extensible sections. In this embodiment, arm sections 54 are shorter than the corresponding arms in the embodiment of FIG. 1, and rear arm sections 101 are telescopically mounted within arm sections 54. Arm sections 54 and 101 are approximately equal in length, and in an easel having the dimensions previously given for the embodiment of FIG. 1, each of these sections might, for example, have a length on the order of 13 inches. The extensible arms have an advantage in that when they are retracted, they do not protrude as far as the one-piece arms of FIG. 1. This reduces the amount of space required behind the easel when it is in its upright position, and it also reduces the hazard of someone running into a protruding arm.

Means is provided for releasably securing arm sections 101 in a desired position. This means comprises a pair of detent pins 102 which project laterally from the ends of a U-shaped spring member 103. The spring members are mounted in the forward ends of rear arm sections 101, with detent pins 102 being received in detent openings 104, 106 in the respective arm sections to hold the arm sections in the desired positions. The position of the arm sections is changed by depressing pins 102 to disengage them from openings 106 and sliding the rear arm sections until the pins engage the openings for the desired position.

The easel has a number of important features and advantages. It is very flexible in that it can be set up or configured to hold a wide variety of work pieces in a variety of positions. It is readily adjustable, and it can be disassembled for transportation or storage simply by loosening the thumbscrews, removing the legs which form the base and the arms which carry the work piece holders, and separating the telescoping sections. When assembled, the easel is very strong and stable, and can easily support work pieces of relatively large size.

It is apparent from the foregoing that a new and approved easel has been provided. While only one presently preferred embodiment has been described in detail, as will be apparent to those familiar with the art, certain changes and modifications can be made without departing from the scope of the invention as defined in the following claims.

I claim:

1. In an expandable easel for holding work pieces of different sizes: a frame comprising a pair of upstanding posts and at least one cross member extending between the posts, each of said posts and said cross member having a plurality of telescopically extensible sections whereby the height and the width of the frame can be adjusted to receive work pieces of different sizes, a plurality of work piece support arms which project outwardly in a horizontal direction from the frame and can be adjusted to extend different distances from the frame, the spacing between the support arms changing as the frame is adjusted for work pieces of different sizes, and a work piece holder mounted on each of the support arms.

2. The easel in claim 1 wherein each of the work piece support arms comprises an L-shaped arm having an outer section which carries the work piece holder and can be oriented in different rotative positions in a vertical plane to further vary the spacing between the work piece holders.

3. The easel of claim 1 wherein each of the work piece holders comprises a clamp engageable with the work piece and means mounting the clamp for pivotal movement about two axes whereby the clamp can be moved to different positions for engagement with different workpieces.

4. In an expandable easel for holding work pieces of different sizes: a plurality of upstanding posts having upper and lower sections which can be extended and retracted relative to each other to change the lengths of the posts, an upper cross member of adjustable length extending between the upper sections of the posts, a lower cross member of adjustable length extending between the lower sections of the posts and being slidably connected to the posts to permit adjustment of the position of the lower cross member along the posts, a first pair of L-shaped arms mounted on the upper sections of the posts for movement between different rotative positions relative to the posts, a second pair of L-shaped arms mounted on the lower sections of the posts for movement between different rotative positions, and a work piece holder carried by each of the L-shaped arms.

5. The easel of claim 4 wherein the second pair of L-shaped arms is mounted in brackets carried by the lower cross member.

6. The easel of claim 4 wherein each of the work piece holders includes means permitting pivotal movement of the holder about two axes for engagement with different work pieces.

7. The easel of claim 4 wherein the L-shaped arms are adjustable relative to the plane of the posts and the cross members whereby a work piece held by the holders can be inclined at different angles relative to the posts and cross members.

8. The easel of claim 4 including a central vertical arm positioned between the posts and connected to the upper cross member, means slidably connecting the lower cross member to the vertical arm, and a central cross member of adjustable length slidably mounted on the vertical arm and connected to the lower sections of the posts.

9. The easel of claim 8 including stop means carried by one of the cross members for limiting the distance by which the posts can be separated.

10. The easel of claim 4 including a pair of horizontally extending arms at the lower ends of the posts, said arms extending rearwardly from the posts and having ground engaging wheels at the rear ends thereof.

11. The easel of claim 10 wherein the first pair of L-shaped arms extends rearwardly from the posts and are engagable with the ground to support the work piece in a horizontal position when the easel is tilted back about the wheels.

12. In an expandable easel for holding work pieces of different sizes: a plurality of upstanding posts having upper and lower sections which can be extended and retracted relative to each other to change the lengths of the posts, an upper cross member of adjustable length extending between the upper sections of the posts, a lower cross member of adjustable length extending between the lower sections of the posts, first and second work piece holders mounted on the upper and lower sections of the posts, one of the cross members having a plurality of telescopically extensible sections, a stop member pivotally mounted in one of the sections and engagable with a slot in another one of the sections, and means for yieldably urging the stop member into engagement with the slot to limit the distance by which the posts can be separated.

13. The easel of claim 12 wherein the stop member has a surface at one end thereof for abutment against one end of the slot to prevent further extension of the cross member when the stop member is engaged with the slot and an oppositely facing inclined surface engagable with the other end of the slot for deflecting the stop member out of engagement with the slot as the cross member is moved toward a retracted position.

14. In an expandable easel for holding work pieces of different sizes: a frame comprising a pair of upstanding posts and at least one cross member extending between the posts, each of said posts and said cross member having a plurality of telescopically extensible sections whereby the height and the width of the frame can be adjusted, a plurality of work piece holders mounted on the frame in such manner that the spacing between the work piece holders can be adjusted to hold work pieces of different sizes, a first pair of horizontally extending arms at the lower ends of the posts engageable with a supporting surface for supporting the frame in an upright position, and a second pair of horizontally extendable arms toward the upper ends of the posts, said arms extending rearwardly from the frame and being engageable with the supporting surface for supporting the frame in a horizontal position when the frame is tilted rearwardly about the lower pair of arms.

15. The easel of claim 14 wherein the lower pair of arms has wheels at the rear end thereof.

16. The easel of claim 14 wherein the arms at the lower ends of the posts can be adjusted forwardly and rearwardly relative to the posts.

17. In an easel for holding work pieces of different sizes: a frame adapted to receive work pieces of different sizes, and a plurality of work piece holders mounted on the frame, each of said work piece holders having a base, a pivot pin mounting the base on the frame for rotational motion about the axis of the pin, an arm hingedly connected to the base for pivotal movement about an axis perpendicular to the axis of the pin, and means carried by the arm for engagement with the work piece.

18. The easel of claim 17 wherein the arm comprises a generally J-shaped arm with two generally parallel sections, and the means for engagement with the work piece comprises a clamping screw threadably mounted in one of the generally parallel sections of the J-shaped arm.

19. In combination; a work piece having a peripheral frame with a central opening and a canvas mounted on the frame, an adjustable support, and a plurality of work piece holders mounted on the support, each of said work piece holders comprising a J-shaped hook which extends through the opening in the peripheral frame from the back side of the canvas and engages the front side of the frame, and a clamping screw threadably mounted in the hook and engaging the back side of the frame to secure the frame and the hook together.

20. In an easel for holding a work piece comprising a canvas mounted on a peripheral frame: a support, a first work piece holder mounted on the support for engagement with a first side of the frame, and a second work piece holder mounted on the support for engagement with a side of the frame opposite the first side, each of said work piece holders comprising a J-shaped hook which is adapted to extend through an opening in the peripheral frame from the back side of the canvas and to engage the front side of the frame, and a clamping screw threadably mounted in the hook for engagement with the back side of the frame to secure the frame and the hook together, said J-shaped hooks having openings which face away from each other and are adapted to receive the opposite sides of the frame therein.

* * * * *